US006860624B2

(12) United States Patent
Hille et al.

(10) Patent No.: US 6,860,624 B2
(45) Date of Patent: Mar. 1, 2005

(54) LIGHT SYSTEM

(75) Inventors: Jonathan D. Hille, Tempe, AZ (US); Jeffrey B. Berghoff, Gilbert, AZ (US); Jon T. Lundquist, Chandler, AZ (US)

(73) Assignee: Atom Lighting, Inc., Tempe, AZ (US)

( * ) Notice: Subject to any disclaimer, the term of this patent is extended or adjusted under 35 U.S.C. 154(b) by 57 days.

(21) Appl. No.: 10/081,598

(22) Filed: Feb. 20, 2002

(65) Prior Publication Data

US 2003/0156418 A1 Aug. 21, 2003

(51) Int. Cl.[7] ..... F21V 21/26

(52) U.S. Cl. ..... 362/427; 362/153.1; 362/270; 362/275; 362/287; 362/371

(58) Field of Search ..... 362/293, 153.1, 362/270, 275, 287, 371, 427

(56) References Cited

U.S. PATENT DOCUMENTS 4,712,168 A * 12/1987 Scherrer ..... 362/427
5,144,540 A * 9/1992 Hayes ..... 362/268
5,230,559 A * 7/1993 Porter et al. ..... 362/153.1
5,823,664 A * 10/1998 Demshki, Jr. et al. ..... 362/366
5,887,966 A * 3/1999 Eissner et al. ..... 362/153.1
5,908,236 A * 6/1999 Lueken et al. ..... 362/364
6,036,337 A * 3/2000 Belfer ..... 362/287
6,068,384 A * 5/2000 Tyson et al. ..... 362/153.1

* cited by examiner

*Primary Examiner*—Thomas M. Sember
*Assistant Examiner*—Jacob Y. Choi
(74) *Attorney, Agent, or Firm*—Snell & Wilmer L.L.P.

(57) ABSTRACT

A lighting fixture is provided wherein the lighting fixture comprises a lamp and a positioning assembly. The positioning assembly is configured to allow translational, and rotational positioning of the lamp relative to a housing. The positioning assembly is also configured to be received by a housing.

19 Claims, 8 Drawing Sheets

LIGHT SYSTEM

FIELD OF INVENTION

The present invention relates, generally, to lighting systems.

BACKGROUND OF THE INVENTION

Lighting fixtures serve a wide variety of applications. For example, lighting fixtures are used in interior applications, such as lighting the lobby of an office building. Lighting fixtures are also used in exterior applications, such as on the grounds of buildings, in parks, and in a multitude of locations generally requiring illumination. In general, well light fixtures advantageously provide illumination while hiding and/or protecting the lighting fixture components. Enclosing lighting fixture components within a well can improve safety and aesthetics. In addition, well lights can serve to protect the components from tampering, for example by vandals, and from damage by lawn mowers, trimming machines, and animals.

In particular, well light fixtures are often used in below grade installations. These below grade installations can be found in walkways, turf, planters, and other hardscape settings involving concrete, asphalt, gravel, pave stones, tile, and the like. Some well light fixtures include a collar. Collars can be used, for example, to affix the perimeter of the lighting fixture to the surrounding environment. However, some well light collars can cause undesirable deflections in the lighting housing, and allow weeds, grass, soil and debris to infiltrate the lighting fixture.

In general, present day well lights are time consuming to install. Installations typically require numerous adjustments to direct the illumination in the right direction or to provide a desired lighting effect on an object. To make these adjustments, the well light installer must often use several tools, and the use of these tools further slows the installation. Furthermore, large numbers of well light fixtures are often installed on a single project, thus tending to increase the value of well lights that are more flexible and faster to install. In addition, well lights are typically limited in the range of motion available for the lighting fixture.

SUMMARY OF THE INVENTION

In accordance with various exemplary embodiments of the present invention, a lighting fixture comprises a lamp fixture and a positioning assembly. The lighting fixture may also comprise a housing. In an exemplary embodiment, the positioning assembly is configured to be received by the housing. In another exemplary embodiment of the present invention, the positioning assembly is configured to allow translational and rotational positioning of the lamp fixture.

BRIEF DESCRIPTION OF THE DRAWING

The subject matter of the invention is particularly pointed out and distinctly claimed in the concluding portion of the specification. The invention, however, both as to structure and method of operation, may be understood by reference to the following description taken in conjunction with the claims and the accompanying drawing figures, in which like parts may be referred to by like numerals:

DETAILED DESCRIPTION

An apparatus and method in accordance with various aspects of the present invention provide an improved lighting system for illumination of objects. In this regard, the present invention may be described in terms of functional block components and various processing steps. Such functional blocks and steps may be realized by any number of devices and techniques configured to perform the specified functions. For example, a light system, according to various aspects of the present invention, may employ various mechanical joining devices, e.g., bolts, screws, adhesive, thumb screws, and the like.

In accordance with various aspects of the present invention, a lighting system may facilitate, among other things, lamp range of motion, installation and repair time, and fixture integrity. A lamp fixture may be suitably supported by a positioning assembly, and may be positioned, for example, with both rotational and linear movement allowing illumination adjustments. The rotational movement may include yaw and/or pitch rotational movements. The lighting fixture may be configured for tool-less adjustment and access. The fixture may further include an integrated collar on a housing, thus enhancing fixture integrity. Furthermore, the lamp fixture may provide a sealed environment for protecting lamp components from water.

Figure 1:
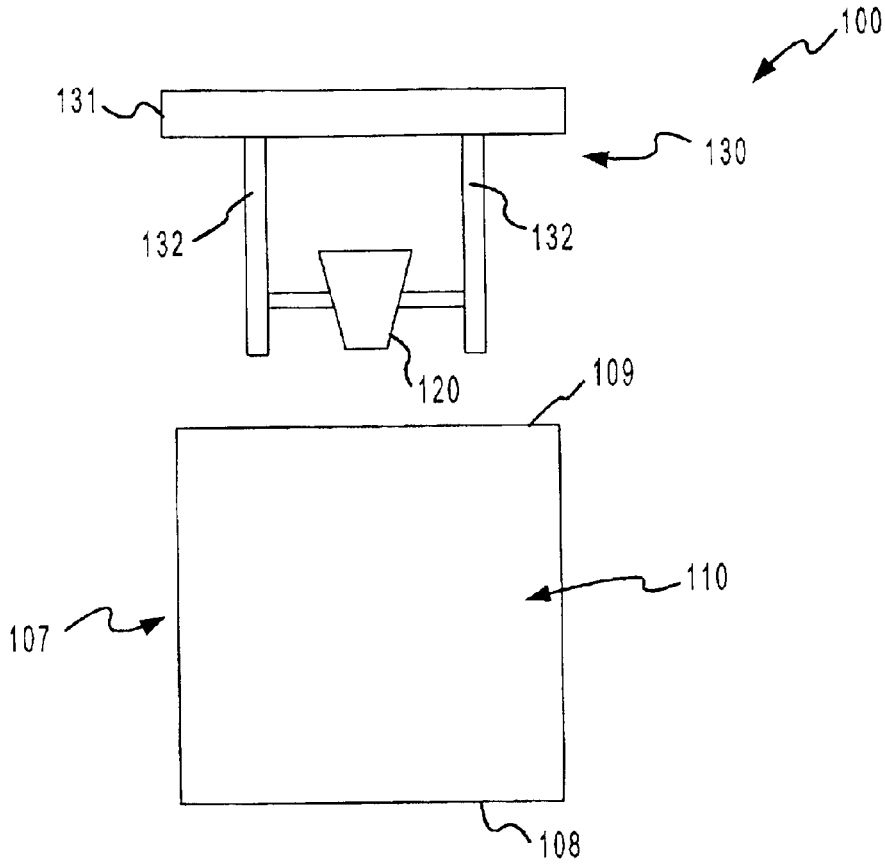
FIG. 1 is an exploded side view of a lighting fixture according to various aspects of the present invention.

In accordance with an exemplary embodiment of the present invention, and with reference now to FIG. 1, a lighting fixture 100 includes a housing 110, a lamp fixture 120, and a positioning assembly 130. The housing 110 may be configured to support the positioning assembly 130, which may be configured to support the lamp fixture 120. The positioning assembly 130 is suitably further configured to allow translational and rotational positioning of the lamp fixture 120. The lighting fixture 100 may be configured such that the housing 110 contains the lamp fixture 120 and portions of the positioning assembly 130.

In accordance with various aspects of the present invention, the housing 110 is configured to contain the lamp fixture 120 and/or to protect portions of the lighting fixture 100. The housing 110 may also be configured to support the positioning assembly 130. The housing 110 may include housings of various shapes and sizes.

The housing 110 may include any suitable object capable of protecting and/or supporting the lamp fixture 120. The housing 110 may include a side(s) 107, a top end 109 and a bottom end 108. The ends 108, 109 may be completely or partially open or closed to facilitate access to the housing, drainage, power supply, ventilation, or other utility. In the present embodiment, for example, the top end 109 is open and configured to receive the positioning assembly 130. The bottom end 108 may be configured to be open or closed. In an exemplary embodiment of the present invention, the bottom end 108 is open to allow moisture present in the housing to drain. To further this drainage, the soil or other material below the housing 110 may be prepared to facilitate such draining. For example, gravel may be placed under a ground installed housing 110. Furthermore, when the housing 110 is configured with the bottom end 108 open, power supplying cable may enter through the bottom end 108. In embodiments in which the bottom of housing 110 is closed, power cables may enter through conduit couplings in the bottom or side of the housing 110.

Figure 2:
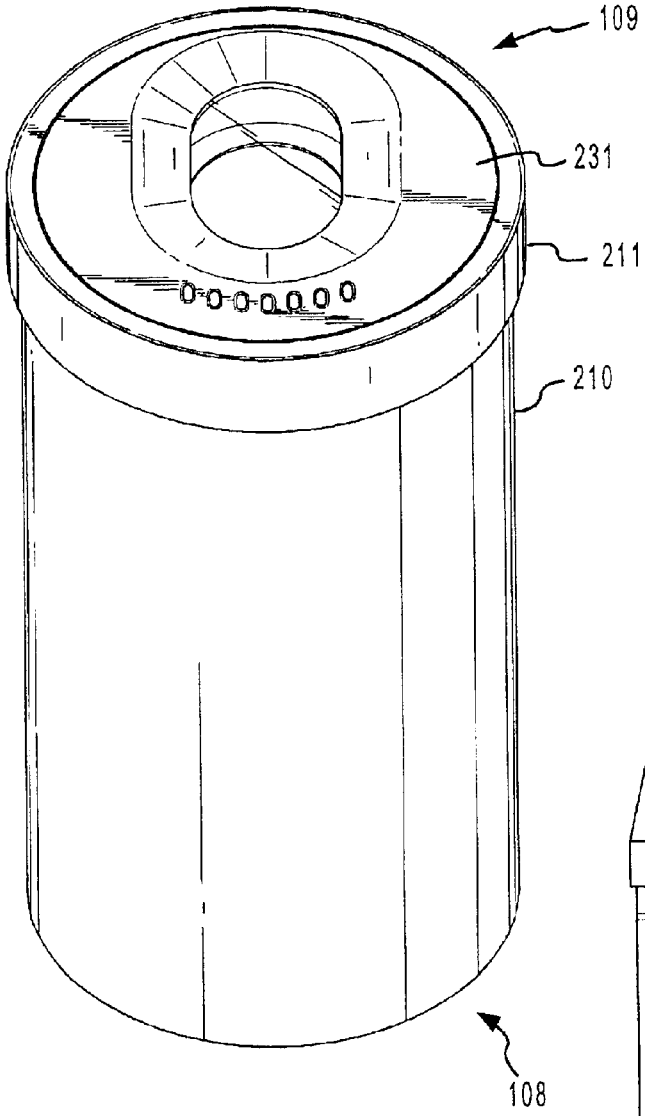
FIGS. 2 and 3 are perspective views of a lighting fixture according to various embodiments of the present invention.
Figure 3:
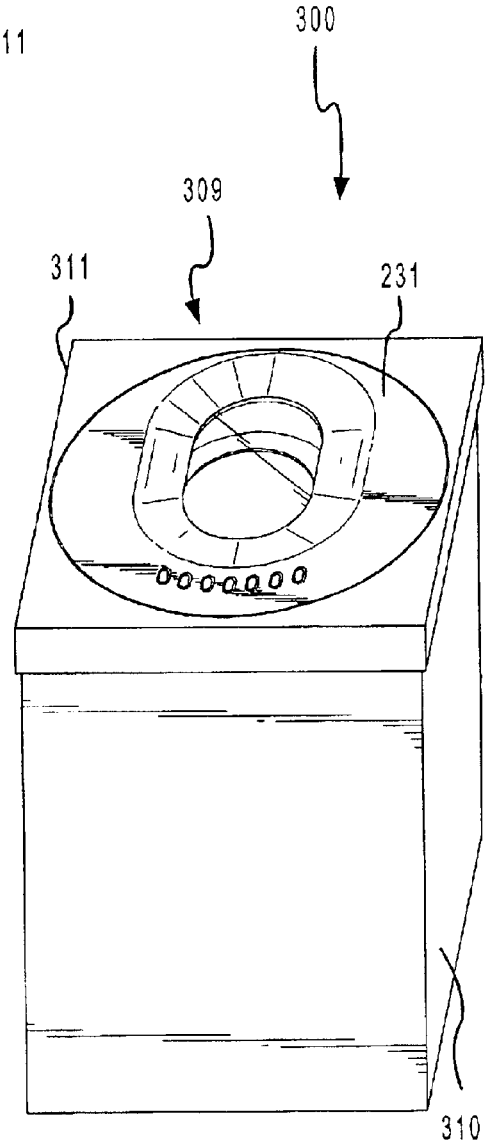

In accordance with various exemplary embodiments of the present invention, and with reference to FIGS. 2 and 3, the housing 110 may be configured in any suitable shape and configuration, including any cylindrical configuration such as a circular cylinder, rectangular cylinder, oval cylinder, triangular cylinder, or other cylindrical structure. Although the exemplary embodiments include right cylindrical structures, the cylindrical structure may suitably be formed at angles to the top 109 and bottom 108 ends of the housing. In accordance with one exemplary embodiment of the present invention, the housing 110 is substantially a right circular cylinder 210. The housing 110 may also, for example, be substantially a right rectangular cylinder 310. A right circular cylinder may be described as a structure made of circular sections, wherein the center of each circular section forms a line substantially perpendicular to the top 109 and bottom 108 ends. The term cylinder refers to the lateral sides of the object, whatever the shape, and excluding any top and/or bottom caps.

In general, the housing 110 may be configured to suitably support the positioning assembly 130 and/or to facilitate yaw rotation. For example, with reference now to FIG. 2, the right circular cylinder 210 is configured to facilitate yaw rotation with a circular collar 211 which has a circular receiving surface (not shown). The collar is suitably configured to mate with a circular lid 231 of the positioning assembly 130. Therefore, the circular lid 231 is free to rotate within the circular collar. In other embodiments, and with reference to FIG. 3, square or other shaped cylinders can be configured to facilitate yaw rotation of the positioning assembly. For example, a right square cylinder 310 may be configured with a square collar 311 which is adapted to receive the circular lid 231. For example, the square collar 311 may be configured with a circular receiving surface in the square top end 309 of the square cylinder lighting fixture 300. Therefore, the circular lid 231 is free to rotate within the square top collar 311.

In these various embodiments, the lamp fixture 120 can be positioned throughout the 360° rotation relative to circular cylinder. Although the present lighting fixture 100 has yaw and pitch rotational positioning movement capabilities, in various embodiments, one or the other may be omitted from the present invention. For example, if yaw rotation is omitted, square or other shaped lids may be used.

The housing 110 may be constructed of any suitable material selected for any suitable purpose. For example, the housing 110 may be made of a corrosion resistant material such as, but not limited to polyvinyl chloride ("PVC"), glass reinforced composites, and the like. As another example, an exposed housing 110 may be made of stainless steel for architectural effect.

Also, the housing 110 may further be constructed by any suitable construction technique, such as, extrusion and/or injection molding, casting, machining, stamping, or the like. In another exemplary embodiment of the present invention, the housing 110 may be made of standard PVC pipe. The housing 110 may further be suitably coated, for example to prevent rusting, corrosion, patina process, etc. Furthermore, the housing 110 may be painted or otherwise colored to enhance reflectivity, or achieve other illumination effects.

In accordance with various embodiments of the present invention, the housing 110 is configured to be installed in either above grade or below grade installations in a wide variety of environments. For example, the housing 110 may be configured to be installed substantially below grade with primarily a top portion of the housing 110 visible and with the surface of a top portion of the positioning assembly 130 installed substantially flush with the surface of the terrain within which the lighting fixture is installed. While the present lighting fixture may be suitably installed within a landscape in a hole prepared in the ground, the lighting fixture may also be installed in other architectural environments, such as in walkways, vehicular drives, steps, columns, building facades, or other structures. Furthermore, the housing 110 is not limited to "hidden" or below grade installations and can be installed with the housing exposed.

In various embodiments of the present invention, the housing 110 is configured to have a selected height. The height may be selected based on any appropriate criteria. For example, the height may be selected to reduce the depth of the hole or receptacle that is prepared to receive the housing 110. For example, the housing 110 height is suitably configured to be about 12 inches, although any appropriate height may be used.

In various embodiments of the present invention, the housing 110 is configured to have a selected diameter. The diameter may be selected based on any suitable criteria. For example, the diameter may be selected to accommodate the lamp fixture 120 size and movement. In one exemplary embodiment of the present invention, the housing 110 diameter is suitably configured to be approximately 7 inches, although any suitable diameter may be used.

Figure 4:
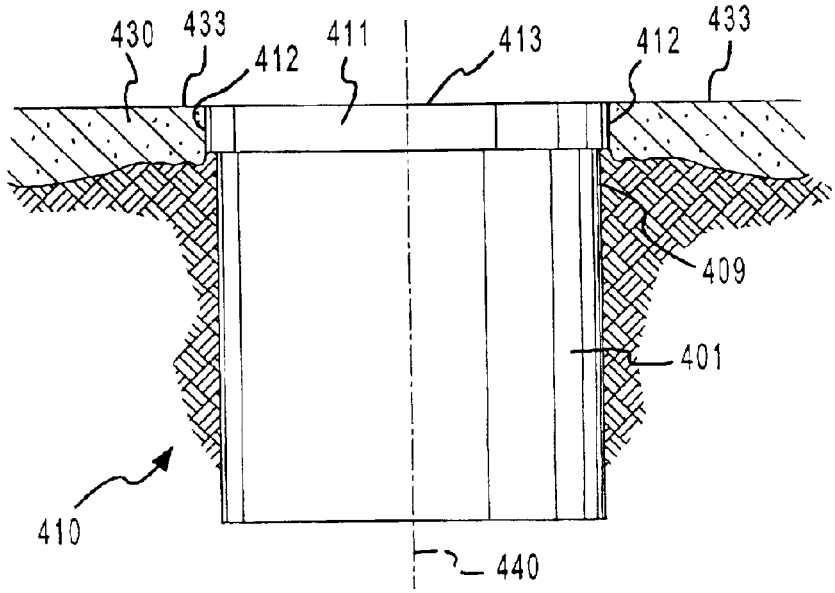
FIG. 4 is an side view of a lighting fixture as installed according to various aspects of the present invention.

In accordance with various aspects of the present invention, the housing 110 may be configured to support the positioning assembly 130 with or without the use of a collar. With reference now to FIG. 4, a second housing 410 according to various aspects of the present invention may be further configured to include a pour collar 411 mated to a top end 409 of a cylinder 401. The pour collar 411 is suitably configured to support and/or facilitate rotation of the positioning assembly 130. The pour collar 411 may further be configured for mating with concrete, tile, turf, gravel, pave stones, or the like. For example, the top surface 433 of concrete 430 may be poured substantially flush with a top surface 413, and adjacent to a side surface 412, of the pour collar 411. As noted above, however, the second housing 410 may also be installed in situations where the top surface 413 is not flush with any surroundings, such as in exposed or partially exposed installations.

The pour collar 411 may further be configured to allow the positioning assembly 130 to be inserted and removed from the second housing 410. The positioning assembly 130 may be physically maintained in contact with the second housing 410 through a variety of mechanisms. For example, in one embodiment of the present invention, the positioning assembly 130 may be held in contact with the second housing 410 by gravity. In this embodiment, the second housing 410 is physically positioned with the axis 440 of the cylinder 401 oriented in a substantially vertical direction. Other orientations, however, including horizontal orientations and downward orientations may be utilized. In such orientations, the positioning assembly 130 may be fastened to the second housing 410, such as by set screws, clips, or other restraining devices (not shown).

Figure 5:
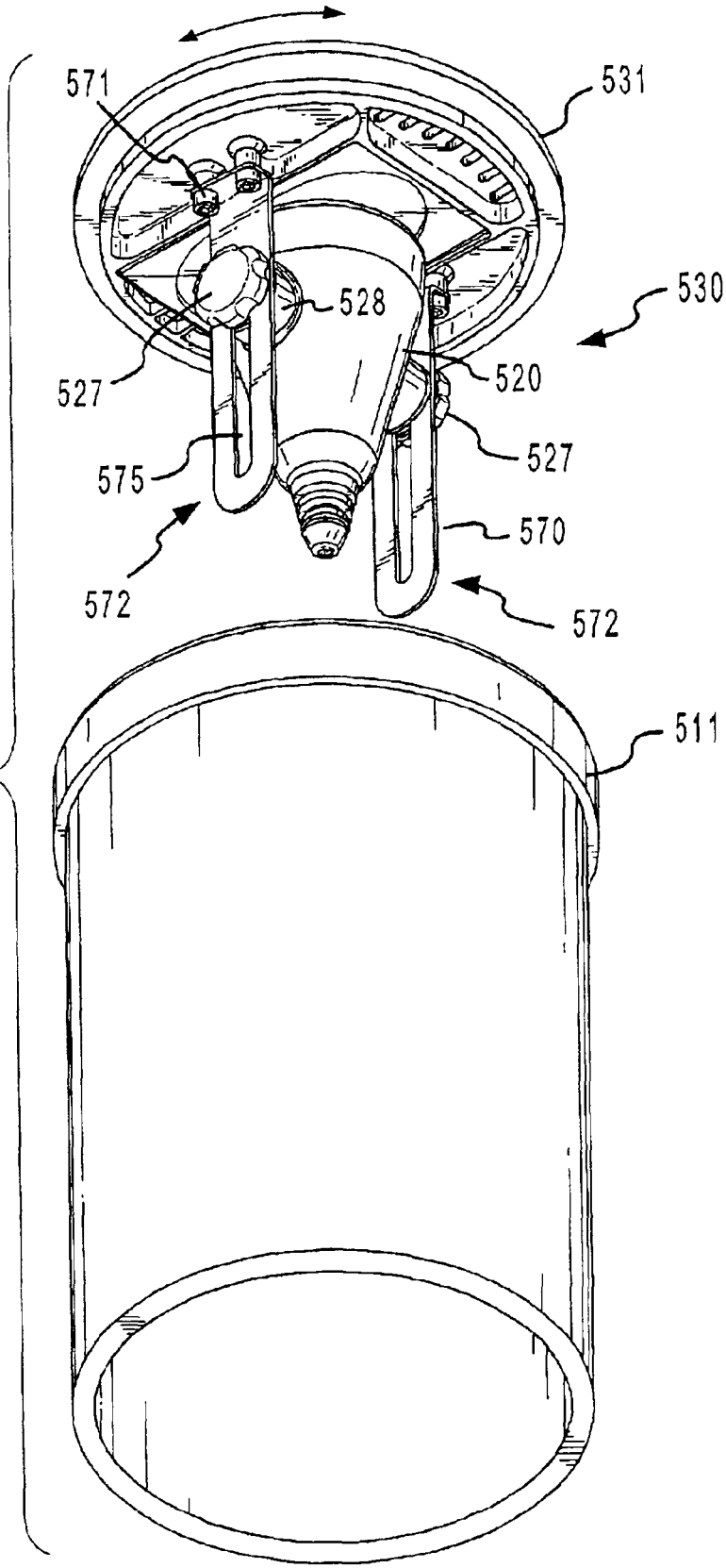
FIG. 5 is an exploded view of a lighting fixture according to various embodiments of the present invention.

Referring now to FIG. 5, a circular collar 511 may be configured such that a second positioning assembly 530 is removable, even after pouring concrete or other material up to the circular collar 511 and thus fixing the circular collar 511 relative to the surrounding environment. Removability of the second positioning assembly 530 facilitates adjusting the positioning of a second lamp fixture 520, replacing components, and removing any debris from the interior of the well light. Furthermore, in one exemplary embodiment of the present invention, a circular lid 531 mates with a circular collar 511 having a circular receiving surface (not shown) allowing the positioning assembly 530 full 360° rotation and further facilitating positioning of the light.

A collar, in accordance with various embodiments of the present invention, may be configured to receive the positioning assembly in any suitable manner. For example, with reference to FIG. 6, an exemplary integral collar 611 may include a receiving surface 614 for supporting or mating with the positioning assembly 130. In one exemplary embodiment of the present invention, the receiving surface 614 is configured to be recessed from or lower than a top side surface 613 such that the positioning assembly 130 mounts flush with the top side surface 613. In such a configuration, the positioning assembly 130 may be rotated and/or inserted and removed from mating with the collar 611 even when the collar 611 is fixed relative to a surrounding material.

In an exemplary embodiment of the present invention, the positioning assembly 130 can be turned while seated on the collar 611. Rotation of the positioning assembly 130 within the collar 611 facilitates a first rotational degree of freedom, or yaw, for positioning the lamp fixture 120. This lamp fixture 120 positioning can, for example, be performed while the lighting fixture is fully assembled, and without tools, thus facilitating quick positioning adjustments of the lamp fixture 120.

A collar 611, in accordance with various embodiments of the present invention, may be configured to be attached to a second cylinder 601 by any appropriate material or mechanism. For example, attachment to the second cylinder 601 may be made by an adhesive such as an elastomeric silicone product or other suitable bonding agent. Attaching the collar 611 to the second cylinder 601 by adhesive tends to maintain the shape of the second cylinder 601 and/or collar 611. Deformation of, for example, either the second cylinder 601 or the collar 611, may prohibit the free rotation of the positioning assembly 130 and otherwise detract from the overall mating of the positioning assembly 130 to a third housing 610. In other embodiments of the present invention, the collar may be attached to the second cylinder 601 by set screws, and the like.

In various exemplary embodiments of the present invention, the collar 611 is suitably formed as an integral part of a third housing 610, for example, by forming a single piece through injection molding. In another exemplary embodiment of the present invention, the collar 611 is suitably integrally attached to the second cylinder 601. For example, the collar 611 may be configured to have an outer lip 632 and an inner lip 634 which are configured for receiving the second cylinder 601 between the outer lip 632 and the inner lip 634. In this manner, the collar 611 is attached to both the outer surface 633 and inner surface 636 of the top end 609 of the second cylinder 601.

Integral attachment or formation of the collar 611 and the second cylinder 601 may substantially prevent grass, weeds, soil, and debris from growing or otherwise coming between the collar 611 and the second cylinder 601. The elimination of element penetration facilitates mating of the positioning assembly 130 to the third housing 610 and tends to provide enhanced overall appearance and durability.

Figure 7:
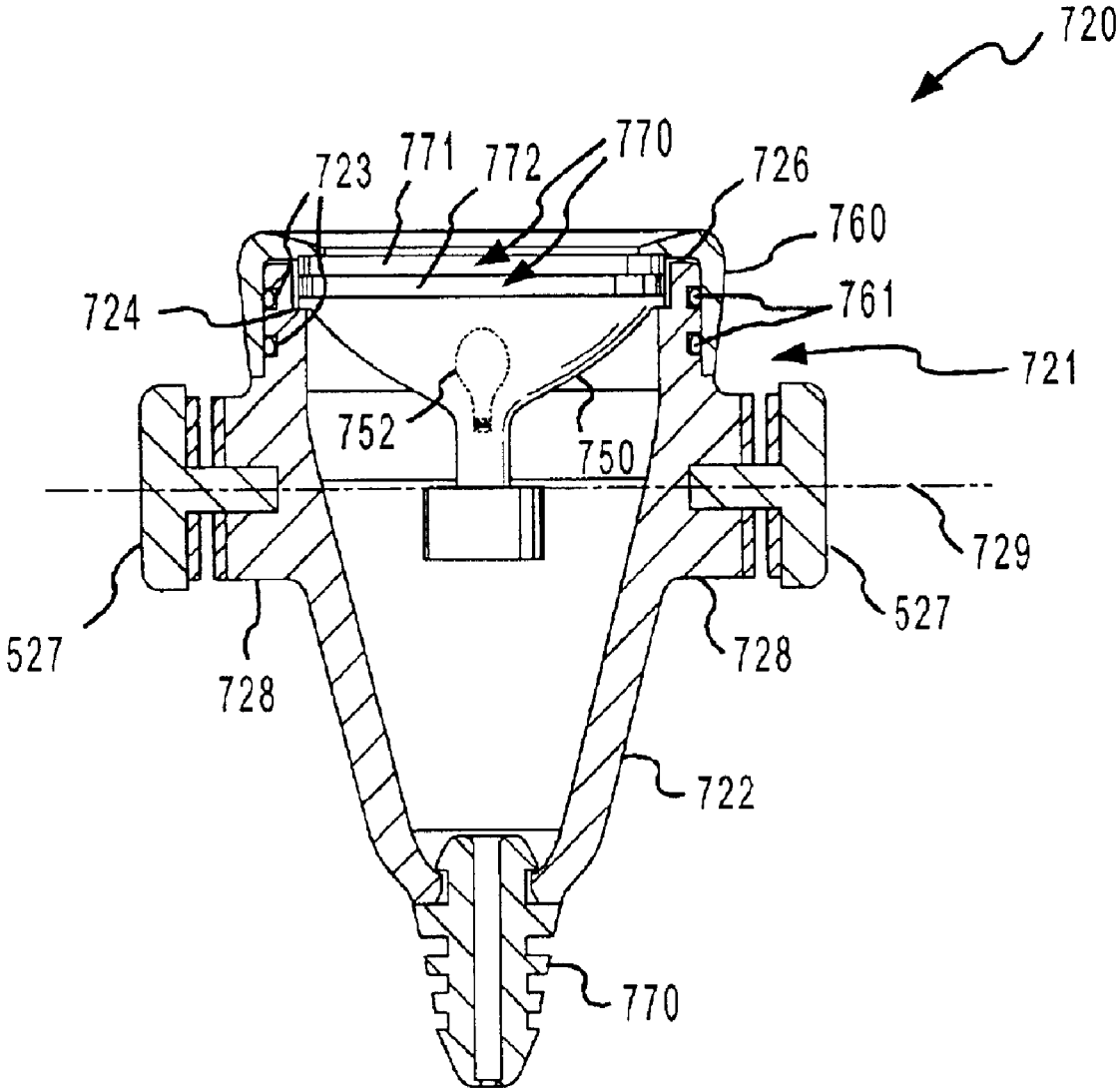
FIG. 7 is a side cross-sectional view of a lamp fixture of a lighting fixture according to various aspects of the present invention.

With reference now to FIG. 7, a third lamp fixture 720 may include a lamp fixture body 721, a reflector 750, and a lamp 752. The lamp fixture body 721 may be configured to support the reflector 750 and/or the lamp 752. The reflector 750 is suitably configured to reflect the light from the lamp 752, which provides illumination. The lamp fixture body 721 may further be configured to include one or more parts for, among other things, supporting and protecting the components within the lamp fixture.

In accordance with an exemplary embodiment of the present invention, the lamp fixture body 721 comprises a lamp fixture base 722 and a lamp fixture cap 760. The lamp fixture cap 760 may be removably attached to the lamp fixture base 722 by any suitable mechanism, such as screw-on lamp fixture caps, snap-on lamp fixture caps, or the like. The removable lamp fixture cap 760 allows access for replacing lamps, lenses, and/or socket and wiring components. In an exemplary embodiment of the present invention, the lamp fixture cap 760 is attached to the lamp fixture base 722 by a friction fit against one or more O-rings 761, thus facilitating access to the inside of the lamp fixture body 721. The lamp fixture base 722, in accordance with an exemplary embodiment of the present invention, includes one or more circular machined surface notches 723, for receiving the one or more O-rings 761.

The O-ring(s) 761 may be suitably configured to create an air/water tight seal and prevent outside elements from reaching the components within the lamp fixture body 721. By preventing air from escaping the lamp fixture body 721, substantial water resistance is facilitated even when the lamp fixture body 721 is submerged in water. A double O-ring 761 may provide increased water resistance as well as stability and strength of attachment for the lamp fixture cap 760. In addition, the O-ring 761 configuration may facilitate simple and tool-less removal and replacement of the lamp fixture cap 760.

The lamp fixture body 721 may be suitably configured to support the lamp 752 and/or the reflector 750. For example, the lamp fixture base 722 may include a support shelf 724 for maintaining the position of the reflector 750 of the lamp 752, lens(es) 770, and the like. The support shelf 724 may be suitably recessed below the top most surface 726 of the lamp fixture base 722 to facilitate holding the reflector 750 and one or more lenses 770 while allowing the lamp fixture cap 760 to be fully seated. Although the support shelf 724 may be half an inch below the top most surface 726 in one embodiment of the present invention, other dimensions may suitably be used.

In accordance with various aspects of the present invention, the third lamp fixture 720 may be configured to a permit selective inclusion of one or more cover and/or filter lenses 770. For example, a cover lens 771 may be provided in the third lamp fixture 720 for, among other things, protecting the lamp 752. The cover lens 771 may be either loose within or fixedly attached to the lamp fixture body 721. For example, the cover lens 771 may be fixedly attached, by any mechanism, to lamp fixture cap 760. In one exemplary embodiment of the present invention, an adhesive is used to attach the cover lens 771 to the lamp fixture cap 760. In another exemplary embodiment of the present invention, the third lamp fixture 720 may be configured without lenses.

In one exemplary embodiment of the present invention, one or more filter lens(es) 772 may be included between the reflector 750 and the lamp fixture cap 760. The filter lens 772 may, for example, be held in place between the reflector 750 and the cover lens 771. In various embodiments, the filter lens 772 may be clear in color and appearance. In other embodiments, the filter lens 772 may be configured in any suitable manner to filter light. The filter lens 772 may be suitably configured to generate colored lighting effects or to cause other lighting effects such as reduction of glare and/or enhanced lamp beam spread. The filter lens may also be replaced with a substantially colorless or otherwise optically inactive lens to maintain the relative positions of the reflector 750 and the lamp fixture cap 760.

The lamp 752 and reflector 750 may be any light emitting source, for example, an mr-16 or mr-11 halogen type low voltage lamp. Furthermore, the lamp 752 may suitably include other light emitting elements such as fiber optics, micro electronics, and the like. In one exemplary embodiment of the present invention, the lamp 752 is powered by low voltage, e.g., 12 volt power. In other embodiments, the lamp 752 can be powered by more or less than 12 volts, for example 120 volts. Electrical conductors (not shown) may provide power to the third lamp fixture 720 via a strain relief apparatus 770 which is flexibly attached, e.g., snapped on, to a receiving port of the lamp fixture base 722. The electrical conductors may enter the third lamp fixture 720 via a strain relief apparatus 770 which generally protects the integrity of the terminal connection of the electrical conductors. The strain relief apparatus 770 may include Thermal Plastic Elastomer or other plastics, rubber or similar flexible material.

The lamp fixture base 722 may be further configured to have one or more positioning assembly connection points 728 for movably connecting with the positioning assembly 130. The positioning assembly connection points 728 may be configured to receive any suitable connection mechanism facilitating adjusting and fixing the position of the lamp. In various embodiments, screws, bolts and the like with a variety of heads, such as Allen wrench type heads, and others may be used. In one exemplary embodiment of the present invention, the positioning assembly connection points 728 may be configured to each receive a bolt. The bolt receiving positioning assembly connection points may be co-linear creating an axis of rotation about a line 729 and providing another rotational movement degree of freedom (pitch) for the third lamp fixture 720. In one exemplary embodiment of the present invention, the bolts used to attach the third lamp fixture 720 to the positioning assembly 130 further comprise thumb knob bolts 527, for facilitating tool-less adjustment of the height and rotational setting of the third lamp fixture 720.

In accordance with another aspect of the present invention, and with reference again to FIG. 1, any suitable positioning assembly 130 may be used which facilitates rotational and/or translational movement of the lamp fixture 120 with respect to the housing 110. In one embodiment of the present invention, positioning assembly 130 includes a lid 131 and a linkage assembly 132. In this embodiment of the present invention, the lid 131 is connected to the linkage assembly 132, and the linkage assembly 132 is connected to the lamp fixture 120.

Figure 6:
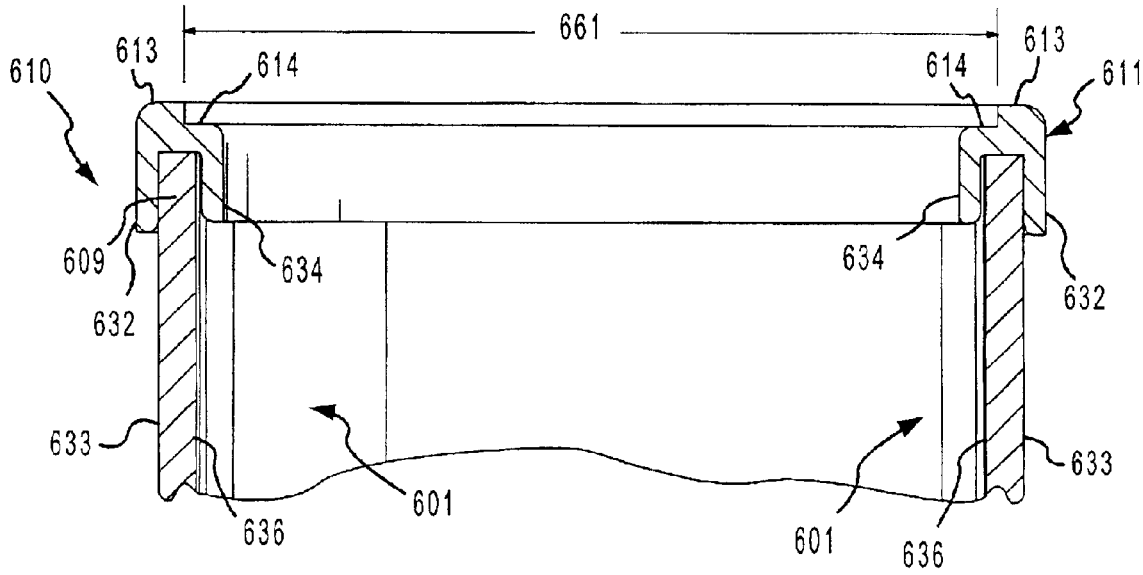
FIG. 6 is an side cross-sectional view of a collar in a lighting fixture according to various aspects of the present invention.
Figure 8:
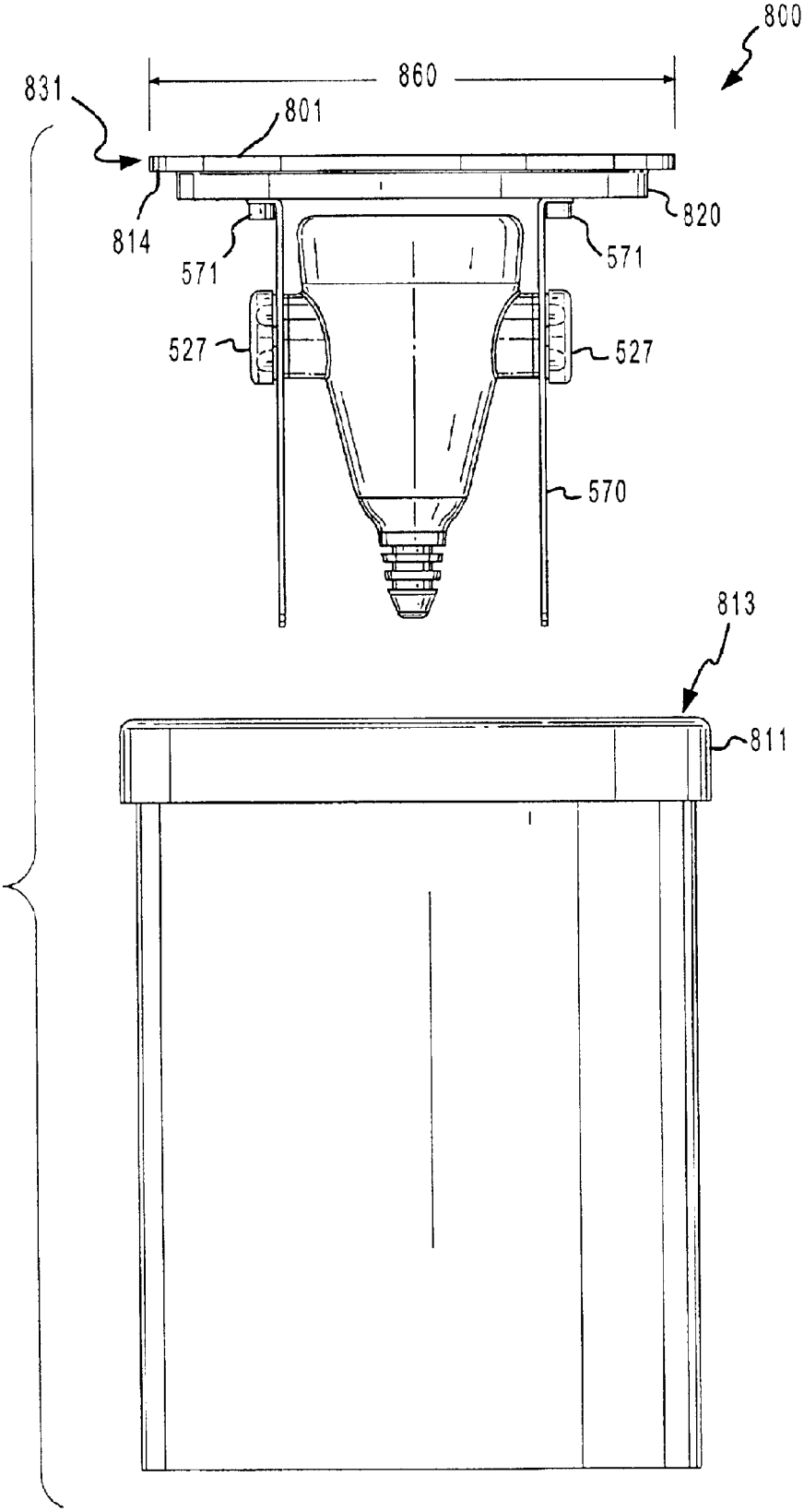
FIG. 8 is an exploded side view of a lighting fixture according to various aspects of the present invention.

Referring now to FIGS. 6 and 8, the lid 831 may include a relatively planar top surface 801, for example, for substantially flush mounting with the surrounding surface and with the top 813 of the collar 811. The lid 831 may further include a surface 814 for mating with a receiving surface 614 of the collar 811. The lid 831 is configured to mate with the collar 811, for example with a lid diameter 860 of about 6 inches, and is configured to be somewhat, e.g. 1/32 inches, smaller in diameter than an outer diameter 661 of the receiving surface 614. Any appropriate dimensions, however, may be used for the cylinder, collar and lid.

Figure 9:
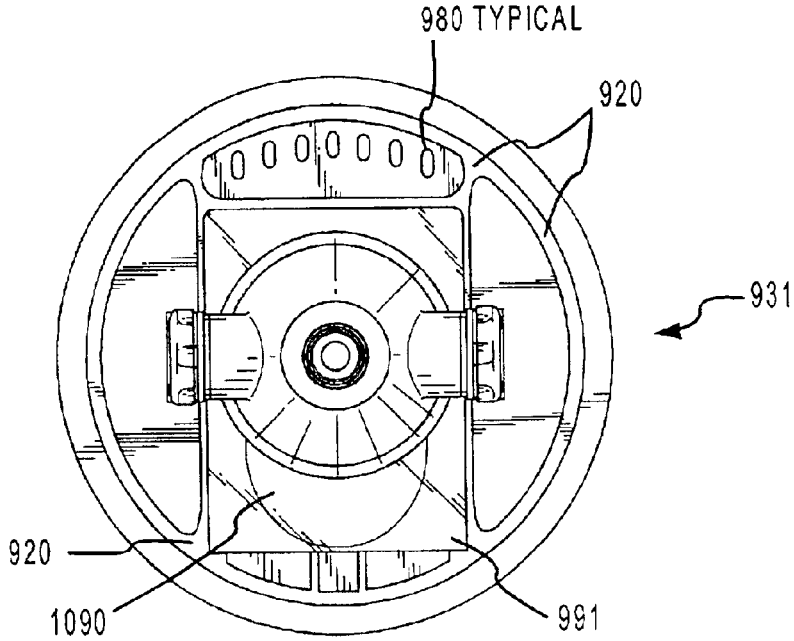
FIGS. 9 and 10 are detailed views of the inner and outer faces of a lid of a lighting fixture, respectively.

The lid 831 may be configured with a suitable support structure 820 for providing added rigidity and stability. With reference to FIG. 9, an exemplary support structure 920 embodiment comprises multiple ribs formed in the bottom surface of the lid 831. Any suitable support structure, however, may be used to provide appropriate rigidity and stability. The support structure 920 may be configured to meet particular loading specifications. For example, a lid 931 often may support the weight of a human, a bike, or a car passing over the lighting fixture.

Figure 10:
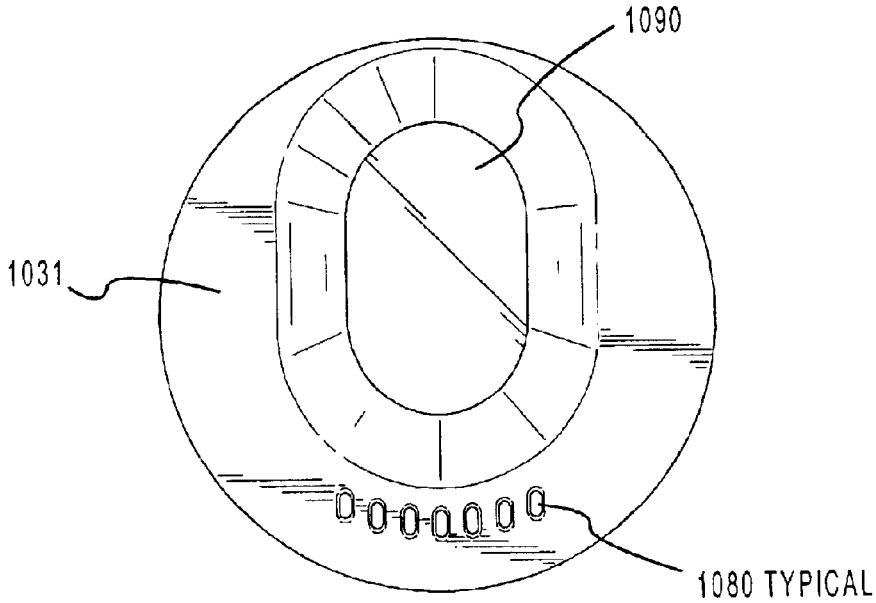

With reference now to FIGS. 9 and 10, the lid 931 and support structure 920 according to various aspects of the present invention include a window 1090 and ventilation holes 1080. The window 1090 includes an opening in a lid 1031 which allows light from within the housing 110 to illuminate objects outside of the housing 110. The window 1090 is suitably oblong, though any suitable shape and size of window may be used.

The window 1090 may suitably be covered or may be an open window. In various exemplary embodiments of the present invention, a covering may also be a partial covering such as a grate, mesh, slat, or other suitable covering. Furthermore, any suitable covering that allows some light to pass through the covering may be used. For example, the covering may be translucent or transparent, and may include materials such as glass, plastic, or other suitably transmissive material. In an exemplary embodiment of the present invention, a glass plate 991 is provided for the window 1090. The glass plate 991 is, for example, large enough to cover the entire window 1090.

The glass plate 991 may be attached to the lid 1031 by any suitable mechanism. For example, mechanical clamps, brackets, slots, groves, pins, and the like may be used for attachment purposes. In the present embodiment, an adhesive is used to attach the glass plate 991 to the lid 1031.

Figure 11:
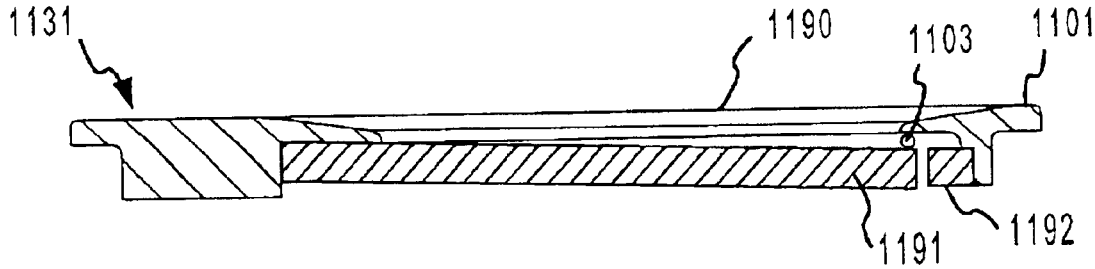
FIG. 11 is a side cross-sectional view of a lid of a lighting fixture according to various embodiments of the present invention.

With reference now to FIG. 11, the glass plate 1191 may be suitably recessed, for example, 1/32 inches below the surface 1101 of the lid 1131 to provide protection to the glass plate 1191. Other dimensions may suitably be used for recessing the glass plate 1191. In this manner, the full weight of a passing object is not placed squarely on the glass, thus reducing the likelihood of breaking the glass plate 1191.

In accordance with one aspect of the present invention, the lid 1131 may be configured to drain water off of the glass plate 1191. For example, the lid 1131 may be configured such that the glass plate 1191 slopes toward a weep hole 1192 when the lid 1131 is installed in a level position. The slope of the glass plate 1191 may, for example, be created by placing one or more spacers 1103 near the weep hole 1192. The lid 1131 and glass plate 1191 may include various other configurations for causing moisture to drain to the weep hole 1192. For example, the lid 1131 can be manufactured with varying thickness such that the glass plate 1191 slopes from one side of the window 1190 to a weep hole 1192 on the other side of the window 1190. The weep hole 1192 may be cut into the lid 1131 at the low end of the glass plate 1191. In another example, the glass plate 1191 may be manufactured with a variable thickness, having one side thicker than the other to generate a slope for facilitating draining. The glass plate 1191 may be secured to the lid 1131 with an adhesive, by mechanical mechanism, or other suitable attachment mechanism.

With reference again to FIGS. 9 and 10, the ventilation holes 1080 allow moisture that may have been introduced into the housing 110 to evaporate. Thus, fog and water droplets that might otherwise cloud the window 1090 tend to be reduced and illumination performance tends to increase. Furthermore, the size and number of ventilation holes may be restricted to reduce the opportunity for leaves and other debris to fall into the housing 110. Also, small ventilation holes tend to reduce potential tampering, as the smaller holes may provide relatively little gripping surface for removing the positioning assembly 130. The ventilation holes 980 of the present embodiment comprise seven oval ventilation holes in one quadrant of the lid 931, though any other numbers and patterns of ventilation holes may also be used. Similarly, although the ventilation holes 980 have approximately a ¼-inch width, other dimensions may also be used.

With reference again to FIG. 5, the positioning assembly 530 may comprise a linkage assembly 570 suitably configured for facilitating translational and rotational motion of the second lamp fixture 520 relative to the housing 110. Various linkage assemblies may be used for adjustably raising/lowering and/or rotatably setting the position of the second lamp fixture 520. For example, the elongated members 572 may have notches or holes which can be selectively chosen for placing the lamp at a specified height.

In one exemplary embodiment of the present invention, the linkage assembly 570 includes two elongated members 572, each having a slot 575 along the vertical length of the elongated member. The elongated members 572 may, for example, be metal strips or other suitable material. Each slot 575 is configured to receive a bolt or other similar object from the second lamp fixture 520. In an exemplary embodiment, a thumb knob bolt 527 is positioned in the slot 575 and attached to the second lamp fixture 520, for example at the positioning assembly connection points 528. Each slot 575 is configured to allow the thumb knob bolt 527 to slide linearly in slot 575 and/or to rotate with a pitch rotation. The second lamp fixture 520 is connected to the linkage assembly 570 such that the linear position and/or pitch rotation can be fixed in a set condition. For example, the thumb knob bolts 527 can be turned and tightened to hold the linear position and rotation of the second lamp fixture 520. The thumb knob bolts 527 may then be loosened, and the second lamp fixture 520 rotated and raised or lowered to adjust the positioning of the second lamp fixture 520 which is then set by re-tightening the thumb knob bolts 527. Other bolt heads may also be used in the place of thumb knob bolts 527.

The linkage assembly 570 may be connected by any suitable mechanism to the lid 531, for example, via bolts 571. Alternatively, the linkage assembly 570 may be riveted to the lid 531 or attached in any other suitable manner.

Raising and lowering the lamp fixture 120 within the housing 110 facilitates allowing more or less light to be emitted from the lighting fixture 100. This may be advantageous where less glare is desired, for example, where people are walking directly over the fixture, or to achieve soft lighting or other illumination effects.

Although the invention has been described herein in conjunction with the appended drawings, the scope of the invention is not so limited. Modifications in the selection, design, and arrangement of the various components and steps discussed herein may be made without departing from the scope of the invention as set forth in the appended claims.

What is claimed is:

1. A lighting fixture, comprising:

a housing, wherein the housing further comprises a pour collar configured to be fixably attached to a top end of a cylinder; and a first assembly supported by the housing, wherein the first assembly comprises:

a lamp fixture;

a lid configured to support the lamp fixture, wherein the lid is held in vertical contact with a first end of the housing by gravity alone, wherein the lid is configured in slidable contact with the housing, and wherein said lid comprises a relatively planar top surface for substantially flush mounting with the top of said pour collar; and a linkage assembly connected to the lid and supporting the lamp fixture, wherein the first assembly is configured to facilitate linear and both pitch and yaw rotational positioning of the lamp fixture, and wherein the first assembly is configured such that the step of removing the lid also removes the linkage assembly and the lamp fixture.

2. The lighting fixture of claim 1, wherein the housing comprises a cylindrical structure, and wherein the lid is further configured to facilitate rotation of the first assembly about an axis through the radial center of the cylindrical structure.

3. The lighting fixture of claim 1, wherein the lid further comprises a window and wherein the window comprises a transparent covering configured to be recessed relative to a top surface of the lid of the positioning assembly, wherein the lid comprises a weep hole, and wherein the lid is configured to drain water off the surface of the transparent covering through the weep hole.

4. A lighting fixture, comprising:

a housing; and a first assembly supported by the housing, wherein the first assembly comprises:

a lamp fixture;

a lid configured to support the lamp fixture, wherein the lid is held in vertical contact with a first end of the housing by gravity alone, and wherein the lid is configured in slidable contact with the housing; and a linkage assembly connected to the lid and supporting the lamp fixture, wherein the first assembly is configured to facilitate linear and both pitch and yaw rotational positioning of the lamp fixture, wherein the first assembly is configured such that the step of removing the lid also removes the linkage assembly and the lamp fixture, wherein the linkage assembly further comprises an elongated member defining a slotted groove, and wherein the slotted groove is configured to receive a thumb-bolt assembly for slideably adjusting and fixing the distance between the lamp fixture and the lid.

5. The lighting fixture of claim 4, wherein the slotted groove and thumb-bolt assembly are further configured for rotatably adjusting and fixing the pitch of the lamp fixture relative to the lid.

6. The lighting fixture of claim 1, wherein the collar is configured to attach to the cylinder on both the outer and inner surfaces of a first end of the cylinder.

7. The lighting fixture of claim 1, wherein the housing has a second end and wherein the second end is configured to be an open end.

8. A lighting fixture, comprising:

a housing; and a first assembly supported by the housing, wherein the first assembly comprises:

a lamp fixture;

a lid configured to support the lamp fixture, wherein the lid is held in vertical contact with a first end of the housing by gravity alone, and wherein the lid is configured in slidable contact with the housing; and a linkage assembly connected to the lid and supporting the lamp fixture, wherein the first assembly is configured to facilitate linear and both pitch and yaw rotational positioning of the lamp fixture, wherein the first assembly is configured such that the step of removing the lid also removes the linkage assembly and the lamp fixture, wherein the lamp fixture further comprises:

a lamp fixture body;

a lamp; and a reflector, wherein the reflector is configured to reflect light from the lamp, wherein the lamp fixture body is configured with a support shelf for supporting the reflector, wherein the lamp fixture body is further configured to support a filter lens, and wherein the lamp fixture body further comprises a lamp fixture cap and a lamp fixture base, and wherein the lamp fixture cap and lamp fixture base are configured to slideably connect to each other with at least one O-ring between the lamp fixture cap and lamp fixture base, and wherein the lamp and the reflector are within the lamp fixture body.

9. A lighting fixture comprising:

a housing, wherein the housing further comprises a pour collar configured to be fixably attached to a top end of a cylinder;

a lamp fixture, wherein the lamp fixture is configured to be a low voltage lamp fixture;

a positioning assembly, wherein the positioning assembly is configured to allow translational and both pitch and yaw rotational positioning of the lamp fixture, wherein the positioning assembly is configured to be received by a housing, wherein the positioning assembly is configured to allow moisture to enter the housing, wherein the positioning assembly further comprises a lid, and wherein said lid comprises a relatively planar top surface for substantially flush mounting with the top of said pour collar.

10. The lighting fixture of claim 9, wherein the positioning assembly further comprises:

the lid configured to be supported by the housing, wherein the lid further comprises a window; and a linkage assembly connected to the lid and supporting the lamp fixture.

11. The lighting fixture of claim 10, wherein the window comprises a transparent covering configured to be recessed relative to a top surface of the lid of the positioning assembly, wherein the lid comprises a weep hole, and wherein the lid is configured to drain water off the surface of the transparent covering through the weep hole.

12. A lighting fixture comprising:

a housing;

a lamp fixture, wherein the lamp fixture is configured to be a low voltage lamp fixture;

a positioning assembly, wherein the positioning assembly is configured to allow translational and both pitch and yaw rotational positioning of the lamp fixture, wherein the positioning assembly is configured to be received by a housing, and wherein the positioning assembly is configured to allow moisture to enter the housing;

wherein the positioning assembly further comprises:

a substantially planar lid configured to be supported by the housing, wherein the lid further comprises a window; and a linkage assembly connected to the lid and supporting the lamp fixture, and wherein the linkage assembly further comprises an elongated member defining a slotted groove, wherein the slotted groove is configured to receive a thumb-bolt assembly for slideably adjusting and fixing the distance between the lamp fixture and the lid of the positioning assembly.

13. The lighting fixture of claim 12, wherein the slotted groove and thumb-bolt assembly are further configured for rotatably adjusting and fixing the pitch of the lamp fixture relative to the lid of the positioning assembly.

14. The lighting fixture of claim 9, wherein the collar is configured to attach to the cylinder on both the outer and inner surfaces of a first end of the cylinder.

15. The lighting fixture of claim 9, wherein the housing has an open end opposite the end of the housing that is configured to receive the positioning assembly.

16. The lighting fixture of claim 9, wherein the positioning assembly and lamp fixture are removable from the housing as a unit, and wherein the unit comprises a lid, a linkage assembly and the lamp fixture.

17. The lighting fixture of claim 9, wherein the lamp fixture further comprises:

a lamp fixture body;

a lamp; and a reflector, wherein the reflector is configured to reflect light from the lamp, wherein the lamp fixture body is configured with a support shelf for supporting the reflector, wherein the lamp fixture body is further configured to support a filter lens, wherein the lamp fixture body further comprises a lamp fixture cap and a lamp fixture base, and wherein the lamp fixture cap and lamp fixture base are configured to slideably connect to each other with at least one O-ring between the lamp fixture cap and lamp fixture base.

18. The lighting fixture of claim 13, wherein the lamp fixture further comprises:

a lamp fixture body, wherein the lamp fixture body further comprises a lamp fixture cap and a lamp fixture base, and wherein the lamp fixture cap and lamp fixture base are configured to slideably connect to each other with at least one O-ring between the lamp fixture cap and lamp fixture base, and wherein the lamp fixture body further comprises at least one positioning assembly connection point configured to receive the thumb bolt;

a lamp; and a reflector, wherein the reflector is configured to reflect light from the lamp and wherein the lamp fixture body is configured with a support shelf for supporting the reflector.

19. A method for using a lighting fixture comprising the steps of:

positioning a housing, wherein the housing further comprises a pour collar configured to be fixably attached to a top end of a cylinder;

adjusting the elevation of a lamp fixture relative to a top surface of a lid while the lid is not placed on the housing;

adjusting the pitch of the lamp fixture relative to the top surface of the lid while the lid is not placed on the housing;

placing the positioning assembly onto the housing; and adjusting the yaw of the lamp fixture relative to a vertical line perpendicular to the top surface of the lid while the lid is placed on the housing, wherein said lid comprises a relatively planar top surface for substantially flush mounting with the top of said pour collar.

* * * * *